United States Patent [19]

Ferguson

[11] Patent Number: 4,586,309

[45] Date of Patent: May 6, 1986

[54] TWO-COURSE SHINGLE PANEL

[76] Inventor: Stewart Ferguson, P.O. Box 376, Pacific Beach, Wash. 98571

[21] Appl. No.: 595,076

[22] Filed: Mar. 30, 1984

[51] Int. Cl.[4] ..... E04D 1/00

[52] U.S. Cl. ..... 52/540; 52/553; 52/555

[58] Field of Search ..... 52/540, 553, 554, 557, 52/555, 560, 552

[56] References Cited

U.S. PATENT DOCUMENTS

| | | | |
|---|---|---|---|
| 2,384,686 | 9/1945 | Kraus | 52/540 |
| 2,513,977 | 7/1950 | Wells | 52/557 X |
| 3,440,777 | 4/1969 | Martin | 52/94 |
| 3,664,081 | 5/1972 | Martin et al. | 52/540 |

*Primary Examiner*—Carl D. Friedman

*Attorney, Agent, or Firm*—Robert W. Beach; Ward Brown

[57] ABSTRACT

A panel composed of wood sawn tapered shingles including an undercourse of longer shingles and an upper course of shorter shingles disposed with the tips of the shingles in the two courses even and the shingles of the two courses being integrated by staples penetrating both courses of shingles and extending into a narrow cleat behind the undercourse of shingles. The lower edge of the cleat is spaced from the butts of the shingles of the undercourse for engagement with the tips of the shingles of the next lower panel to serve as a gauge for establishing the relative positions of adjacent upper and lower panels applied to a roof or sidewall.

7 Claims, 4 Drawing Figures

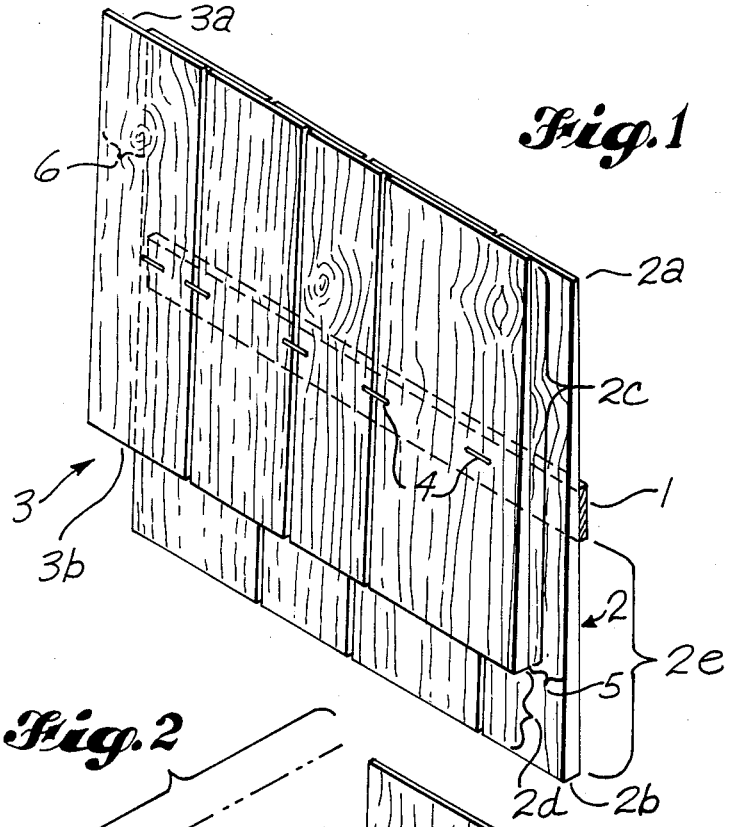
Fig. 1
Fig. 2
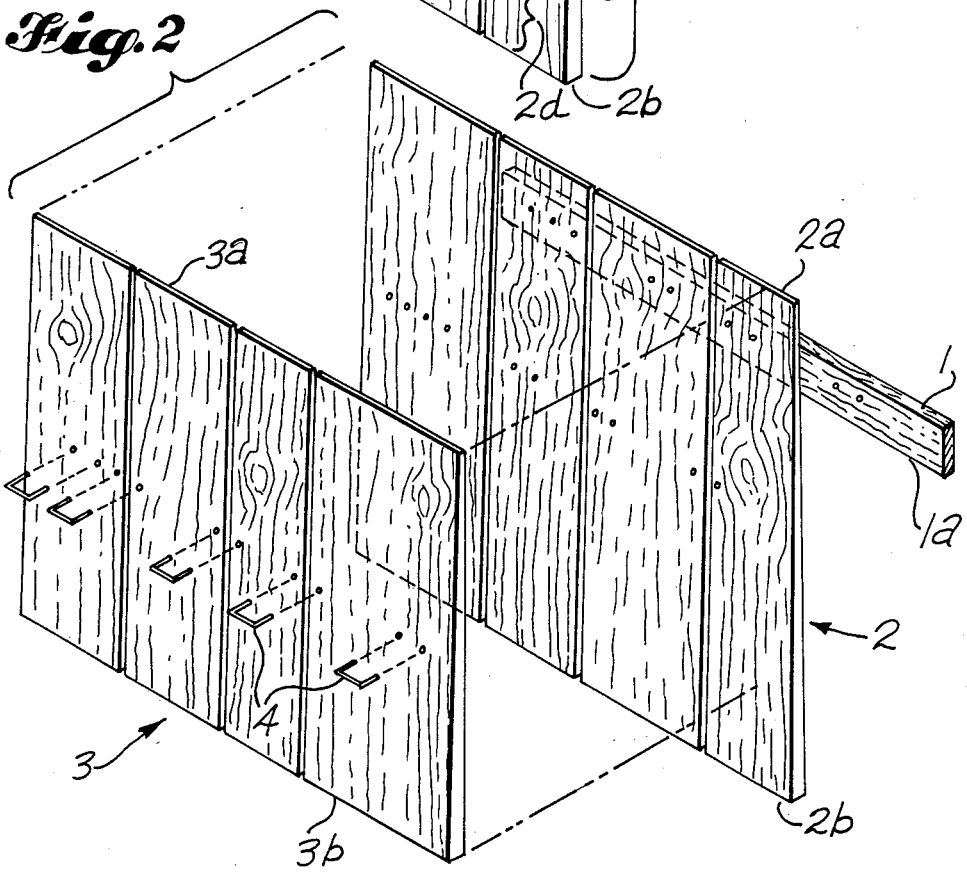

TWO-COURSE SHINGLE PANEL

BACKGROUND OF THE INVENTION

1. Field of the Invention

This invention relates to wood sawn shingle panels and, particularly, to shingle panels having two courses the butts of which are spaced elevationally whether the panels are applied to a roof or to a sidewall.

2. Prior Art

Many proposals have been made for incorporating individual wood sawn shingles into panels at a factory so as to reduce the time and skill required to apply such panels on a roof or sidewall as compared to applying individual shingles. In some instances, the panel includes a backing sheet or base board on which a facing of shingles is mounted. Such a panel is shown in Martin U.S. Pat. No. 3,440,777, issued Apr. 29, 1969, in which the backing or base board is a plywood sheet to which two overlying courses are applied, the undercourse being of tapered, sawn wood shingles, and the upper course being of resawn split wood shakes which are of even thickness throughout their length. The shakes in the upper course and the shingles in the undercourse project equal distances below the lower edge of the base strip.

The Martin et al. U.S. Pat. No. 3,664,081, issued May 23, 1972, discloses a panel having a plywood sheathing or base member to which a single course of upper facing material is applied. Such facing may be wood shakes or shingles or other material. To the underside of the sheathing or backing is secured a gauge strip 16 which may be abutted with the upper edge of the sheathing in the next lower panel or with the upper edge of the facing material in the next lower panel to position adjacent upper and lower panels in predetermined relationship.

SUMMARY OF THE INVENTION

It is an object of the present invention to provide a shingle panel which is effective for use on a roof or a sidewall, but which makes better use of scarce and expensive wood material. More specifically, it is an object to avoid the necessity of using a large base or backing element of material such as plywood. A shingle panel without such a backing also provides a lighter product.

A further object is to provide a shingle panel which is quick and easy to apply to a roof or sidewall, which can be laid correctly by inexperienced personnel and which can conveniently be cut to finish the shingle covering at the end of a roof or wall or at a roof ridge.

Another object is to provide wood shingle panels that can be used to make a roof or sidewall the appearance of which cannot be distinguished from a roof or sidewall constructed by applying individual shingles.

It is also an object to provide a type of wood shingle panel that can be made in a convenient size for packing, shipping and applying to a roof or sidewall.

The foregoing objects can be accomplished by a panel composed of two courses of random width sawn tapered wood shingles arranged in overlapping break joint relationship and stapled to a backing cleat extending transversely of the length of the panel. The shingles in the upper course are shorter than the shingles in the undercourse by an amount equal to the width of the butt portions of the shingles in the undercourse to be exposed to the weather. The shingles are secured to the cleat with the tips of the shingles in the upper course and in the undercourse even with each other, and the butts of the shingles in the upper course spaced from the butts of the shingles in the undercourse a distance equal to the interval of exposure of the butt portions of the shingles in the undercourse. The backing cleat will be disposed with its lower edge spaced upwardly from the butts of the shingles in the undercourse. Its location establishes the overlap of the butt portions of the undercourse shingles over the tip portions of the shingles in the upper course of the next lower panel.

BRIEF DESCRIPTION OF THE DRAWINGS

FIG. 1 is a top perspective of a shingle panel in accordance with the present invention viewed from the face side, and FIG. 2 is a corresponding top perspective of the shingle panel shown in FIG. 1 with the upper course and undercourse of shingles and the integrating cleat shown in exploded relationship.

DETAILED DESCRIPTION

Figure 3:
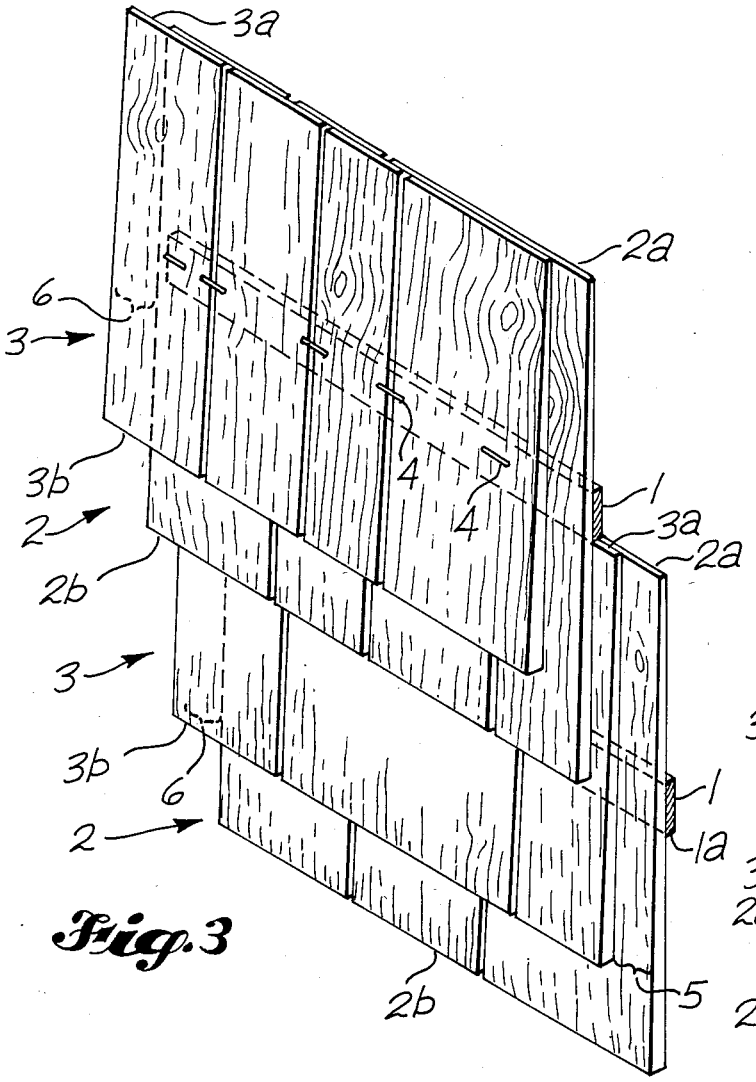
FIG. 3 is a top perspective corresponding to FIGS. 1 and 2 showing two adjacent panels in assembled relationship.

The key features of the panel construction are the cleat 1 which spans the length of the panel generally centrally between its upper and lower edges and the use of short shingles to form the upper course, which save much material. The facing of the panel is then formed by an undercourse 2 of wood sawn tapered shingles arranged in edge-to-edge relationship. The upper course of wood sawn tapered shingles 3 overlies the undercourse of shingles 2. The shingles in the upper and lower courses are of random widths arranged in break joint or shift joint relationship, so that the joints between the upper course shingles 3 are nonaligned with the joints between the shingles 2 of the undercourse, adjacent joints of the two courses being offset by at least about 1½ inches (38.1 mm).

The upper course shingles 3 are arranged with their tips **3*a* even or substantially flush with the tips 2*a* of the undercourse shingles 2. The upper course shingles 3 are shorter than the longer undercourse shingles 2 so that the butts 3*b* of the upper course shingles are spaced upward from the butts 2*b* of the undercourse shingles 2 when the two courses of shingles are assembled by an amount equal to the weather exposure interval of the butt portions of the undercourse shingles 2. With the tips 3*a* of the upper course shingles flush with the tips 2*a* of the undercourse shingles, the upper course shingles will overlie the tip portions 2*c* of the undercourse shingles to provide butt portions 2*d* of the undercourse shingles that will be exposed to the weather when the shingle panels are installed. The greater the difference in length of the upper course shingles 3 and the undercourse shingles 2, the greater will be the exposure interval 2*d* of the butt portions of the undercourse shingle 2** and the greater will be the saving of shingle material.

The interval of exposure **3*d* of the butt portions of the upper course shingles 3 will depend on the length of the upper course shingles 3 and on the spacing 2*e* between the butts 2*b* of the undercourse shingles and the lower edge 1*a* of the cleat 1 which abuts the upper edge of the next lower panel formed by the tips of the shingles in at least one of its shingle layers, and preferably by the tips of the shingles in both layers, as shown in FIG. 3. Such butt portions of the undercourse shingles will overlie the tip portions of the upper course shingles 3 in the next lower panel for that distance. Expressed in another way, the exposure 3***d* of the butt portions of the upper course shingles 3 will depend on the length of the upper course shingles 3 and the spacing between the lower edge of the cleat and the upper edge of the panel if all the panels are similar. The exposure interval 2*d* of the undercourse shingles may or may not be equal to the exposure interval 3*d* of the upper course shingles. The relationship between the exposure interval of the upper course shingles and the exposure interval of the lower course shingles depends on the artistic pattern desired in the completed roof or wall and is governed by the difference in length of the shingles 2 and 3 and the location of the cleat lower edge 1*a* along the length of the undercourse shingles 2.

Exemplary proportions of the undercourse shingles 2 and the upper course shingles 3 may be 16 inches (40.64 cm) in length for the undercourse shingles and 12¾ inches (32.39 cm) in length for the upper course shingles with the cleat 1 located so that the interval 2*e* between its lower edge 1*a* and the butts 2*b* of the undercourse shingles is 7¼ inches (18.42 cm). The interval between the lower edge 1*a* and the tips of the shingles in both layers will be 16 inches (40.64 cm) minus 7½ inches (18.42 cm) equals 8¾ inches (22.22 cm). Under such circumstances, the butt portion exposure interval of the undercourse shingles 2*d* will be 3¼ inches (8.26 cm), and the exposure interval of the upper course shingles 3*d* will be 5½ inches (13.97 cm). The same unequal exposure could be obtained by making the upper course shingles 3 10½ inches (26.67 cm) long instead of 12¾ inches (32.39 cm), in which case the exposure interval 2*d* for the butt portions of the undercourse shingles 2 would be 5½ inches (13.97 cm) and the exposure interval 3*d* for the butt portions of the upper course shingles 3 would be 3¼ inches (8.26 cm).

If, on the other hand, it is preferred that the butt portion exposure interval 2*d* of the undercourse shingles 2 be equal to the butt portion exposure interval 3*d* of the upper course shingles, the length of the undercourse shingles 2 could be 16 inches (40.64 cm ), the length of the upper course shingles could be 11½ inches (29.21 cm) and the spacing 2*e* between the lower edge 1*a* of the cleat 1 and the butts 2*b* of the undercourse shingles could be 7 inches (17.78 cm). Upper such circumstances, the butt portion exposure length 2*d* of the undercourse shingles 2 and the butt portion exposure interval 3*d* of the upper course shingles 3 would both be 4½ inches (11.43 cm).

FIGS. 1 and 2 illustrate the relationship in which the cleat 1, the undercourse shingles 2 and the upper course shingles 3 are assembled. In the finished panel, the upper course shingles 3 are arranged in overlying relationship to the tip portions of the undercourse shingles 2, and both courses of shingles are secured in such relationship by staples 4 penetrating both shingle courses and extending into or through the cleat 1. The tips of such staples may be clinched behind the cleat. The line of staples should be located so that the staples will be covered by the butt portions of the undercourse shingles 2 in the next higher panel. The tips 2*a* of the undercourse shingles 2 and the tips 3*a* of the upper course shingles 3 may be somewhat ragged and uneven when the shingles are assembled, and may be trimmed after such assembly has been completed to provide an even upper panel edge parallel to the lower edge of the cleat 1.

When the panel is completed, the aggregate length of the undercourse formed by shingles 2 in edge-to-edge relationship will be equal to the aggregate length of the upper course formed by shingles 3 in edge-to-edge relationship. The shingles in the two courses will be of such selected widths as to enable them to be arranged in break joint relationship as shown in FIG. 1.

In order to provide a weathertight joint between adjacent ends of adjacent panels, an end lap or half lap joint is used by providing a space 5 between one end of the upper course of shingles 3 and the adjacent end of the undercourse of shingles 2. At the other end of the shingle panel, the end portion 6 of the upper course of shingles 3 will overhang the adjacent end of the undercourse of shingles 2 to the same extent as the spacing 5 at the first end of the panel. In order to match the exposed interval projection 5 and the overhang 6, such projection or overhang can be trimmed to the proper width after the shingle panel has been assembled.

The length of each shingle course of the panel and the cleat 1 should be a multiple of 16 inches (40.64 cm) and 24 inches (61.00 cm), which constitute conventional alternative spacing for roof rafters and wall studs. Such panel length would enable the joint between adjacent panel ends always to overlie a rafter or stud. Consequently, it is preferable for the panel shingle courses to be 48 inches (121.92 cm), that is, 4 feet (12.19 m) in length, which is a convenient size for manufacturing, shipping and handling. The ends of elevationally adjacent panels can be offset and the joints can still be backed by roof rafters or wall studs.

A cleat from 1 inch (2.54 cm) to 3 inches (7.62 cm) in width, preferably 1½ inches (3.81 cm) to 1¾ inches (4.45 cm) in width, and ¼ inch (6.35 mm) to ⅜ inch (9.53 cm) in thickness, will be sufficiently strong to integrate the shingle courses of a panel of that size. Such cleat should be of a thickness substantially equal to the combined thickness of the shingle 3 tips 3*a* and the shingle 2 tips 2*a*.

Figure 4:
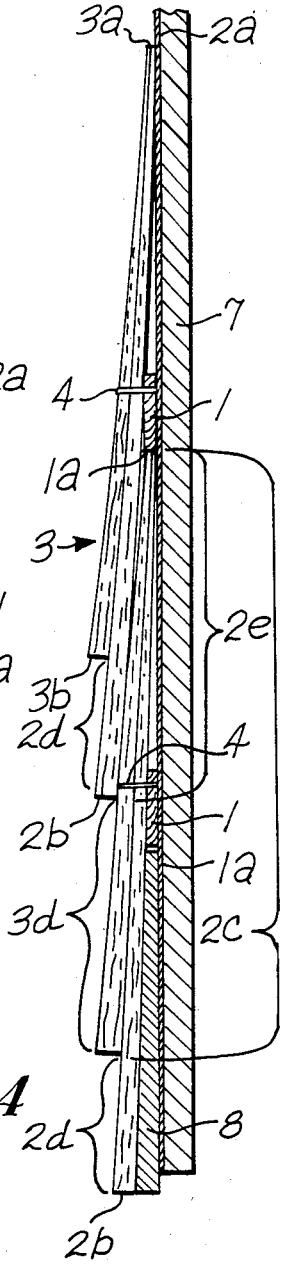
FIG. 4 is a vertical section through a sidewall or roof showing adjacent upper and lower panels applied to such sidewall or roof.

When the shingle panels of the type shown in FIG. 1 are assembled on a wall or roof, as shown in FIGS. 3 and 4, the lower edge 1*a* of the cleat 1 will be placed in abutment with the tips 2*a* of the undercourse shingles 2 and the tips 3*a* of the upper course shingles 3 in the next lower panel, so as to gauge the location of the undercourse shingle panel butts 2*b* with relationship to the tip portions of the upper course shingles 3 in the next lower course, as shown in FIGS. 3 and 4.

Normally the shingle panels will be applied over sheathing 7 shown in FIG. 4, which may be either of the solid type or of the spaced strip type. In the latter case, the sheathing strips should underlie the cleats 1 so that they would be spaced apart a distance equal to the spacing between the lower edges 1*a* of the cleats in adjacent courses which, in each case, will be equal to the sum of the butt portion weather exposures 2*d* of the undercourse shingles 2 and 3*d* of the upper course shingles 3. Thus, in the first example given above, the spacing of the cleats and the underlying spaced sheathing strips edge-to-edge or center-to-center would be 3¼ inches (82.55 mm) for the interval 2*d* and 5½ inches (13.97 cm) for the interval 3*d*, making a total of 8¾ inches (22.22 cm), whereas the interval for the second example given would be 4½ inches (11.43 cm) for interval 2*d* and 4½ inches (11.43 cm) for interval 3*d*, making a total of 9 inches (22.86 cm). Expressed in another way, in the first instance the distance between the lower edge of cleat 1 and the upper edge of the panel would be $8\frac{3}{4}$ inches (22.22 cm) and in the second instance the distance would be 9 inches (22.86 cm).

In starting a wall or roof, it would be necessary to lay initially a single starter undercourse of shingle butt elements 8, as shown at the bottom of FIG. 4.

I claim:

1. A shingle panel comprising only two courses of wood sawn tapered random width shingles in edge-to-edge relationship composed of an undercourse of longer shingles and an upper outer course of shorter shingles much shorter than said longer shingles, the shingles in at least one of said courses being arranged with their tips substantially even for defining the upper edge of the shingle panel and with the butts of said upper outer course shingles spaced a substantial distance from the butts of said undercourse shingles to provide an undercourse weather exposure interval of substantial width between the butt ends of said longer undercourse shingles and the butt ends of said shorter upper outer course shingles, and said undercourse shingles and said upper outer course shingles being arranged in break joint relationship, a cleat much narrower than the vertical panel width, having its length extending lengthwise of said undercourse and of said upper outer course and disposed at the side of said undercourse opposite said upper outer course with its lower edge spaced from the upper edge of the shingle panel a distance establishing the distance which the butt portions of said undercourse shingles will overlie the tip portions of said shorter outer upper course shingles in the next lower panel of a roof or wall structure of similar construction when the lower edge of said cleat abuts the upper edge of such next lower panel, and securing means extending through said shorter upper outer course shingles and said longer undercourse shingles into said cleat for integrating said upper outer course shingles, said undercourse shingles and said cleat into a unitary shingle panel.

2. The shingle panel defined in claim 1, in which the cleat has a width less than one-quarter of the length of the undercourse shingles.

3. The shingle panel defined in claim 1, in which the cleat has a width approximately one-tenth of the length of the undercourse shingles.

4. The shingle panel defined in claim 1, in which the cleat has a thickness approximately equal to the combined thicknesses of the tips of the undercourse shingles and of the upper course shingles.

5. The shingle panel defined in claim 1, in which the length of the shorter upper course shingles does not exceed approximately 80 percent of the length of the longer undercourse shingles.

6. A shingle panel comprising only two courses of wood sawn tapered random width shingles in edge-to-edge relationship composed of an undercourse of longer shingles and an upper outer course of shorter shingles having a length that does not exceed approximately 80 percent of the length of said longer undercourse shingles, the shingles in at least one of said courses being arranged with their tips substantially even for defining the upper edge of the shingle panel and with the butts of said upper outer course shingles spaced a substantial distance from the butts of said undercourse shingles to provide an undercourse weather exposure interval of substantial width between the butt ends of said longer undercourse shingles and the butt ends of said shorter upper outer course shingles, and said undercourse shingles and said upper outer course shingles being arranged in break joint relationship, a cleat having a width approximately one-tenth of the length of said undercourse shingles, having a thickness approximately equal to the combined thicknesses of the tips of said undercourse shingles and of said upper course shingles, having its length extending lengthwise of said undercourse and of said upper outer course and disposed at the side of said undercourse opposite said upper outer course with its lower edge spaced from the upper edge of the shingle panel a distance establishing the distance which the butt portions of said undercourse shingles will overlie the tip portions of said shorter outer upper course shingles in the next lower panel of a roof or wall structure of similar construction when the lower edge of said cleat abuts the upper edge of such next lower panel, and securing means extending through said shorter upper outer course shingles and said longer undercourse shingles into said cleat for integrating said upper outer course shingles, said undercourse shingles and said cleat into a unitary shingle panel.

7. A roof or sidewall constructed of sheathing and similar shingle panels applied over said sheathing, each panel comprising only two courses of wood sawn tapered random width shingles in edge-to-edge relationship composed of an undercourse of longer shingles and an upper outer course of shorter shingles much shorter than said longer shingles, the shingles in at least one of said courses being arranged with their tips substantially even for defining the upper edge of the shingle panel and with the butts of said upper outer course shingles spaced a substantial distance from the butts of said undercourse shingles to provide an undercourse weather exposure interval of substantial width between the butt ends of said longer undercourse shingles and the butt ends of said shorter upper outer course shingles, and said undercourse shingles and said upper outer course shingles being arranged in break joint relationship, a cleat much narrower than the vertical panel width, having its length extending lengthwise of said undercourse and of said upper outer course and disposed at the side of said undercourse opposite said upper outer course with its lower edge spaced from the upper edge of the shingle panel a distance equal to the distance which the butt portions of said undercourse shingles overlie the tip portions of said shorter outer upper course shingles in the next lower panel of the roof or sidewall by abutment of the lower edge of said cleat with the upper edge of the next lower panel, securing means extending through said shorter upper outer course shingles and said longer undercourse shingles into said cleat for integrating said upper outer course shingles, said undercourse shingles and said cleat into a unitary shingle panel, and further securing means securing each panel to said sheathing.

* * * * *